United States Patent [19]

Pappas et al.

[11] Patent Number: 5,071,699

[45] Date of Patent: Dec. 10, 1991

[54] ANTISTATIC WOVEN COATED POLYPROPYLENE FABRIC

[75] Inventors: Robert J. Pappas, Mt. Pleasant; O. Lee Reedy, Summerville, both of S.C.

[73] Assignee: Exxon Chemical Patents Inc., Linden, N.J.

[21] Appl. No.: 651,783

[22] Filed: Feb. 7, 1991

[51] Int. Cl.[5] ..... B32B 7/00

[52] U.S. Cl. ..... 428/265; 383/117; 383/108; 428/226; 428/229; 428/257; 428/922

[58] Field of Search ..... 428/257, 265, 226, 229, 428/922; 383/117, 108

[56] References Cited

U.S. PATENT DOCUMENTS

| | | | |
|---|---|---|---|
| 3,470,928 | 10/1969 | Schwartz | 383/117 |
| 3,660,150 | 5/1972 | Cooper | 383/117 |
| 3,952,128 | 4/1976 | Ogata et al. | 428/265 |
| 3,987,231 | 10/1976 | Hochreuter | 428/265 |
| 4,207,937 | 6/1980 | Sandeman et al. | 383/117 |
| 4,307,144 | 12/1981 | Sanders et al. | 428/265 |
| 4,431,316 | 2/1984 | Massey | 383/117 |
| 4,666,764 | 5/1987 | Kobayashi et al. | 428/265 |

FOREIGN PATENT DOCUMENTS

| | | |
|---|---|---|
| 1143673 | 3/1983 | Canada . |
| 2015426 | 9/1979 | United Kingdom . |
| 2078760 | 1/1982 | United Kingdom . |

OTHER PUBLICATIONS

Electronics, Packaging Spur Developments in Anti-stats, pp. 44–47; Plastics World, Mar. 1989.

*Primary Examiner*—James J. Bell

*Attorney, Agent, or Firm*—Ben C. Cadenhead; T. Dean Simmons

[57] ABSTRACT

The present invention provides for an anti-static flexible fabric material formed from woven, axially oriented crystalline polypropylene yarn, said fabric further characterized as having a coating of a flexible, thermoplastic polymer on one or both sides of the fabric. Anti-static properties are imparted to the fabric by formulating the thermoplastic coating to contain from about 0.2 to about 8% by weight of a polyol ester (preferably glycerol) of a $C_{10}$ to $C_{28}$ fatty acid. The polypropylene yarn may optionally itself also contain a lesser amount of the polyol ester of a $C_{10}$ to $C_{28}$ fatty acid to provide a fabric having even more enhanced anti-static properties. In another embodiment, the polypropylene yarn may additionally have interwoven therewith or in contact therewith at intervals conductive yarns to provide even more enhanced anti-static properties.

A particular advantage of the fabrics of the present invention is that containers constructed therefrom need not be grounded during filling and emptying operations. As static charges are generated, the electrons can flow across the fabric and dissipate or bleed into the atmosphere almost immediately.

12 Claims, 1 Drawing Sheet

ANTISTATIC WOVEN COATED POLYPROPYLENE FABRIC

BACKGROUND OF THE INVENTION

1. Field of the Invention

The present invention relates to textile fabric materials having improved antistatic properties and more particularly to flexible bulk containers made from such fabric material adapted to suppress generation and dissipate static electricity.

2. Description of Related Art

Flexible bulk containers have been utilized for a number of years to transport and deliver finely divided solids such as cement, fertilizers, salt, sugar, and barite, among others. Such bulk containers can in fact be utilized for transporting almost any type of finely divided solid. The fabric from which they are constructed is a weave of a polyolefin, specifically polypropylene, which may or may not receive a coating of a similar polyolefin on one or both sides of the fabric. If such a coating is applied, the fabric will be non-porous, while fabric without such coating will be porous. The usual configuration of such flexible bulk containers involves a rectilinear or cylindrical body having a wall, base, cover and a closable spout secured to extend from the base or the cover or both.

Such containers are handled by placing the forks of forklift hoist means through loops attached to the container. The weight of such bulk container when loaded is usually between 500 pounds and 4,000 pounds, depending upon the density of the material being transported.

Crystalline (isotactic) polypropylene is a particularly useful material from which to fabricate monofilament, multifilament or flat tape yarns for use in the construction of such woven fabrics. In weaving fabrics of polypropylene, it is the practice to orient the yarns monoaxially, which may be of rectangular or circular cross-section. This is usually accomplished by hot-drawing, so as to irreversibly stretch the yarns and thereby orient their molecular structure. Fabrics of this construction are exceptionally strong and stable as well as being light-weight.

Examples of textile fabrics of the type described above and flexible bulk containers made using such fabrics are disclosed in U.S. Pat. Nos. 3,470,928, 4,207,937, 4,362,199, and 4,643,119, the disclosures of which are incorporated herein by reference.

It has been found that the shifting of specific materials within the bulk container as well as friction created between the material and the container during loading and unloading of the container creates localized pockets of built-up static electricity in the container. Spark discharges from the charged container can be dangerous in dusty atmospheres or in close proximity to inflammable solvents, and can be quite uncomfortable to workers handling such containers.

One proposed technique for dissipating electrostatic charges that might otherwise build up during the handling of bulk containers is to provide a fabric wherein conductive yarns are interwoven with the other yarns used in the weaving of the fabric. For example, Canadian Patent 1,143,673 discloses a fabric construction based on polyolefin yarn wherein conductive fibers such as carbon fibers are interwoven longitudinally with the polyolefin yarn and connected to conductive connecting means at the base of the container. This conductive connecting means is adapted to be grounded so that localized static electricity build up does not occur while the container is being filled or emptied.

U.S. Pat. No. 4,431,316 discloses a similar fabric construction comprising a laminate of a first layer of woven polymeric fabric, a second layer of woven polymeric fabric, and an intermediate layer positioned between said first and second woven layers comprising a polymeric material which acts as a moisture barrier. At least one of the woven layers contains spaced threads of staple metal fibers which are disclosed to provide a path in the fabric along which charged ions may travel and a convenient point for electric corona discharge where the conductive fibers protrude outwardly from the container.

One of the disadvantages of these types of construction is that the container made therefrom must be grounded during the fill and emptying operations to provide a path for electrical discharge. Failure to ground the container can lead to the same sort of static build up and the consequent hazard of spark discharge discussed above.

SUMMARY OF THE INVENTION

The present invention provides for an anti-static flexible fabric material formed from woven, axially oriented crystalline polypropylene yarn, said fabric further characterized as having a coating of a flexible, thermoplastic polymer on one or both sides of the fabric. Anti static properties are imparted to the fabric by formulating the thermoplastic coating to contain from about 0.2 to about 8% by weight of a polyol ester (preferably glycerol) of a $C_{10}$ to $C_{28}$ fatty acid. The polypropylene yarn may optionally itself also contain a lesser amount of the polyol ester of a $C_{10}$ to $C_{28}$ fatty acid to provide a fabric having even more enhanced anti static properties. In another embodiment, the polypropylene yarn may additionally have interwoven therewith or in contact therewith at intervals conductive yarns to provide even more enhanced antistatic properties.

A particular advantage of the fabrics of the present invention is that containers constructed therefrom need not be grounded during filling and emptying operations. As static charges are generated, the electrons can flow across the fabric and dissipate or bleed into the atmosphere almost immediately.

DETAILED DESCRIPTION OF THE DRAWINGS

DETAILED DESCRIPTION OF THE INVENTION

Figure 1:
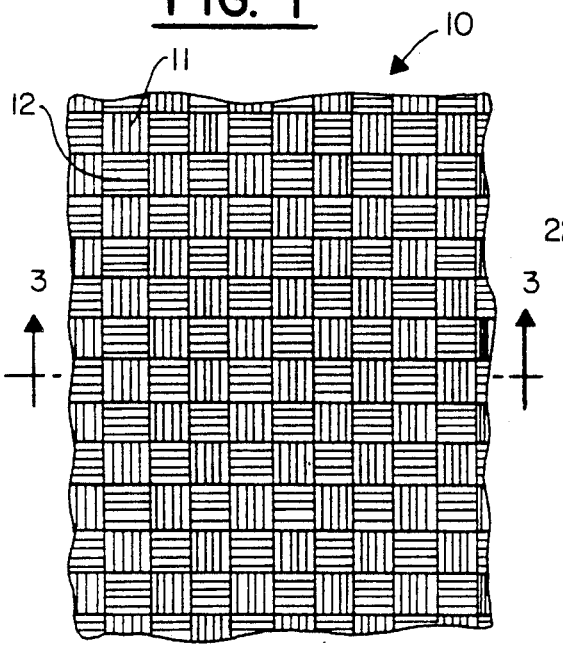
FIG. 1 is a plan sectional view of the body of woven yarn material used in forming the fabric of this invention.

Referring to FIG. 1, the fabric material generally designated as 10 is formed of a fabric composed of a plurality of vertically extending flat warp yarns 11 interwoven with a plurality of horizontally extending flat weft or filling yarns 12. These yarns are interwoven by techniques well known in the art on a textile loom to form a sheet-like material relatively free of interstices. The tightness of the weave depends on the end use. Where the fabric is to be used to fabricate containers for holding large particle size bulk material such as tobacco or pellets, then a fairly open weave of mono or multifilament yarn may be used in a count range of from about 1000 to 3000 denier in each weave direction.

In the more preferred embodiment, the yarns are composed of a tight weave of axially oriented polypropylene flat tape material having a preferred thickness of from about 0.5 to 2 mils and a preferred width of from about 50 to 250 mils. It will be appreciated that by reason of the flat tape yarns, maximum coverage is obtained with the least amount of weaving since it requires relatively few flat yarns per inch to cover a given surface as compared to yarns of circular cross section. It is important that the ribbon-like yarns be highly oriented mono-axially in the longitudinal direction or bi-axially in the longitudinal and transverse directions. This is accomplished by so drawing the flat yarn or the web from which flat yarn ribbons are slit, so as to irreversibly stretch the yarn or web, thereby orienting the molecular structure of the material. In bi-axially oriented yarns or sheeting, the material is hot or cold-stretched both in the transverse and longitudinal directions, but for purposes of the present invention, it is desirable that the orientation be carried out mainly in the longitudinal direction.

When axially oriented polypropylene yarns are interwoven, they cross over in the warp and weft directions, and because of their high tear and tensile strength, as well as their hydrophilic properties, the resultant fabric is highly stable. Thus the bag, if properly seamed is capable of supporting unusually heavy loads without sagging or stretching of the walls of the bag.

Figure 2:
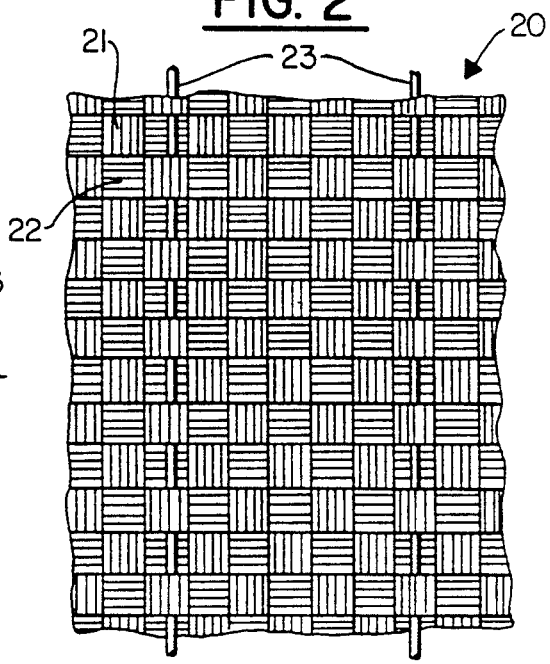
FIG. 2 is a plan sectional view of a second body of woven yarn material containing interwoven electrically conductive fibers at various intervals in the warp direction.

Referring to FIG. 2 which represents another embodiment of the invention, the fabric material generally designated as 20 is formed of a weave of warp yarns 21 and weft yarns 22 as in FIG. 1, but the fabric also contains a plurality of conductive fibers 23 interwoven with the warp flat threads. The purpose of the conductive fibers is to more evenly distribute the static electrical charges which may build upon the surfaces of the fabric and between the inner and outer surfaces of the fabric. The conductive fibers may be present in the warp direction as shown in FIG. 2, or in the weft direction or in both the warp and weft directions. A spacing of the conductive fibers of one fiber per ½ to 2 inches of fabric length or width is generally suitable for dissipation or distribution of the static electrical charge, with one conductive fiber per liner inch of fabric being most preferred.

Fabrics containing interwoven conductive fibers may be generally prepared by taking the polypropylene yarns and the conductive fiber or yarn from separate beams of wound yarn as described in connection with FIG. 11—13 of U.S. Pat. No. 4,362,199, incorporated herein by reference. Preferably single conductive fibers are interwoven with the body threads of the fabric material at regular intervals so that they are evenly spaced apart across the surface of the fabric.

It is not necessary that the conductive fibers be interwoven with the polypropylene yarns, but only that they be in contact therewith. Thus, in another embodiment of the invention, the conductive fibers may be superimposed over the woven polypropylene fabric in a spaced array as discussed above, and a thermoplastic coating applied over the conductive fibers and the woven polypropylene fabric. The thermoplastic coating will fix the conductive fibers in place when it hardens, and in close intimate contact with the polypropylene fabric.

The conductive fiber used in preparing the fabric may be any conductive staple fiber such as stainless steel or copper, as disclosed in U.S. Pat. No. 4,431,316 or a carbon fiber such as disclosed in Canadian Patent 1143673. Preferably, the conductive fiber is itself a plastic material such as a nylon or polyester monofilament which has been coated with a highly conductive metal such as silver or copper. Coating such fibers with conductive metal may be accomplished by techniques well known in the art such as vapor deposition or electrochemical or chemical deposition. General techniques for deposition of metal on plastic surfaces are disclosed, for example, in Volume 10, pp 247–260 of "Encyclopedia of Chemical Technology", Kirk Othmer, 3rd Edition, 1980.

Figure 3:
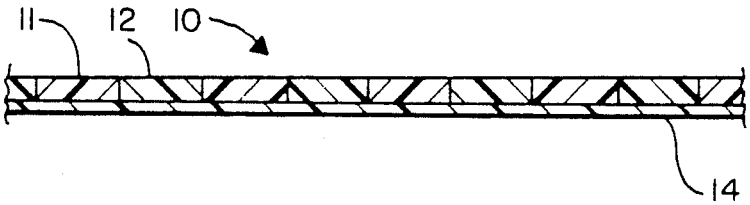
FIG. 3 is a sectional view along axis 3—3 of the body of woven yarn material having a coating of thermoplastic polymer on one surface.

The anti-static fabric of the present invention also contains a coating of thermoplastic polymer material as shown at 14 in FIG. 3 adhered to at least one side of the fabric as shown at 10 in FIG. 3. The purpose of the thermoplastic coating is primarily to seal the interstices of the yarn weave to prevent leakage of any finely divided contents of containers made from the fabric, and also to impart moisture barrier properties to containers or in other fabric applications such as tarpaulen or tent fabrics. In the present invention, the thermoplastic coating also serves as a dispersing base for an antistatic agent which helps impart antistatic properties to the fabric, as more fully discussed below.

The thermoplastic coating may be composed of any thermoplastic polymer composition which is sufficiently non-brittle so that the flexible characteristics of the woven fabric are not seriously diminished and which is adherable to the polypropylene yarn material forming the fabric base. Preferred thermoplastics forming the coating include polypropylene, polyethylene, polyisobutylene, copolymers of ethylene and a lower olefin such as propylene or butene, as well as mixtures of such polymers. Preferred coatings contain a major proportion of polypropylene. The coating may also contain other additives such as fillers, UV absorbers, plasticizers and like ingredients normally formulated into polymeric coatings.

The thermoplastic coating may be applied to one or both surfaces of the woven fabric by techniques known in the art such as extrusion coating, dip coating and spray coating. Generally speaking, the coating may be applied at a dry coating thickness within the range of from about 0.5 to about 3.0 mils, preferably from about 0.8 to about 1.5 mils.

Anti static properties are imparted to the fabric structures of this invention by the inclusion of a minor amount of a polyol ester of a $C_{10}$ to $C_{28}$ monocarboxylic acid or mixture of such acids into the thermoplastic coating formulation, and optionally into both the thermoplastic coating formulation and the polypropylene formulation used to prepare the fabric yarn material. Suitable polyols from which these esters may be derived include ethylene glycol, propylene glycol, glycerol, pentaerythritol and like materials. Preferred esters include mixtures of mono-, di-, and triglycerides (glycerol esters) of $C_{10}$ to $C_{28}$ monocarboxylic acids such as decanoic, lauric, myristic, palmitic or stearic acids, as well as mixtures of such esters. The most preferred esters are esters of $C_{10}$ to $C_{22}$ monocarboxylic acids, and are most preferably stearyl monoglycerides containing at least about 80% by weight of the glycerol monostearate monoester. A preferred group of anti-static compounds are polyol partial fatty acid esters marketed by the Henkel Company under the trade designation DEHYDAT 8312 and DEHYDAT 8316.

In general, good antistatic properties may be obtained by the inclusion of from about 0.2 to about 8% by weight of the antistatic agent into the coating formulation, based on the weight of polymer in the coating. More preferred addition levels of antistatic compound range from about 0.4 to about by weight, with 1 to 6% by weight being most preferred.

The anti static compound may also be incorporated into the polypropylene composition used to prepare the yarn material and at levels of from 0 to about 2% by weight based on the content of polypropylene polymer. Best results are achieved where the anti static compound is present in the yarn material at levels less than it is present in the coating composition. The preferred content of anti static compound when present in the yarn material ranges from about 0.05 to about 1% by weight, with 0.1 to 0.8% by weight being most preferred.

The anti static additive may be mixed with the base polymer in the molten state or with polymer pellets in an extruder. Preferably the antistatic compound is first formulated into a concentrate also containing an olefin polymer such as polyethylene or polypropylene and any other ingredients to be added such as a UV-absorber, plasticizer, filler, dye or the like, and this concentrate is then thoroughly admixed with the base polymer.

The following Examples are illustrative of the invention.

EXAMPLE 1

Warp and weft yarn material for use in preparing a woven fabric was prepared by forming a mixture comprising about 96 parts by weight of a crystalline polypropylene having a melt flow index of 2–3 and about 4 parts by weight of an antistat concentrate which contained a mixture of low density polyethylene, polypropylene having a melt flow index of 12, an ultra violet absorber, and a quantity of antistatic agent identified in Table 1 sufficient to provide the indicated content of anti stat in the final polymer formulation.

The formulation was extruded into a film, slit and drawn to provide 1060 denier warp and 2500 denier weft (or fill) fibrillated strips of monoaxially oriented polypropylene. The processing conditions were generally as follows:

| | |
|---|---|
| Extrusion temperature | 255–265° C. |
| Quench gap | 1–3 inches |
| Quench temperature | 25–35° C. |
| Orienting temperature | 160–190° C. |
| Annealing temperature | 145–155° C. |
| Draw ratio | 7:1–8:1 |

A loom was set up to produce 42" wide fabric cell using 944 warp ends. The strips produced above were woven to produce a solid fabric material composed of 1060 denier warp yarns and 2500 denier weft or fill yarns, with about 10–12 yarn ends per linear inch of fabric.

In those embodiments of the invention wherein a conductive fiber is interwoven with the yarn material, a separate beam of the conductive fiber was used as a source of fiber and a silver-coated monofilament nylon fiber was interwoven in the warp direction and evenly spaced at intervals of about 1inch in the warp yarns.

EXAMPLE 2

Various coating compositions based on a polymer mixture of about 70–75% by weight of polypropylene having a melt flow index of 30–40, about 15 to 25% by weight of low density polyethylene having a melt flow index of 6–9, an ultraviolet absorber and a quantity of anti stat compound as indicated in Table 1 were prepared.

The coating was extrusion-coated through a slot die onto the fabric material prepared in accordance with Example 1 by passing a moving web of the fabric under a hot melt of the coating from the extruder die, followed by cooling the composite to solidify the coating. The dry coating thickness was about 1.1 mil.

EXAMPLE 3 -22

Various samples of fabric prepared in accordance with Examples 1 and 2 above were evaluated for electrostatic properties using the following test methods. Static decay time gives a relative indication of static bleed time. This property was evaluated by test procedures set forth by the National Fire Protection Agency (NFPA), NFPA 99, "Standard for Health Care Facilities", Quincy, MA. (1990). This test requires that a static charge built upon a fabric sample of 5000 volts must dissipate to 500 volts in less than 0.5 seconds in a 50% RH atmosphere in accordance with Method 4046 of Fed Test Method Std. No. 101C. An Electro-tech Systems (Model 406L) static decay meter is used in conducting the test. Both positive and negative static charges are used and the sample is tested three times at each charge.

Surface resistivity measures the surface resistance to electron flow accross the faric surface between two electrodes placed on the surface of the fabric specimens. The measurement is the ratio of the direct voltage applied to the electrodes to that portion of the current between electrodes which is primarily in a thin surface layer. This test was conducted in accordance with ASTM D-257-78.

Results of the evaluation of antistatic properties for fabric structures having the structure and composition indicated in Table 1 are reported in Table 1.

As is indicated in Table 1, Example 3 is a control fabric containing no coating and no antistat in the fabric. Example 4 is a coated fabric containing no antistat in either the coating or the fabric. Examples 10, 11, 18 and 19 are analogous controls except that the fabric contains the specified amounts of antistat. In each case these samples failed the NFPA-99 static decay time test as measured on the coating and fabric side of the samples.

TABLE 1

| EXAMPLE | ANTISTATIC COMPOUND IN: FABRIC YARNS COMPOUND | LEVEL, WT % | POLYMER COATING COMPOUND | LEVEL, WT % | CONDUCTIVE YARN SPACING | NFPA-99 STATIC DECAY TIME seconds, 0.5 s MAX COATING | FABRIC | ASTM D-257 SURFACE RESISTIVITY ohms per square COATING | FABRIC |
|---|---|---|---|---|---|---|---|---|---|
| 3 | NONE | — | NO COATING APPLIED | — | — | >120 | >120 | — | $>10^{14}$ |
| 4 | NONE | — | NONE | — | — | >120 | >120 | $>10^{12}$ | — |
| 5 | NONE | — | GMS* | .8 | — | .10 | .12 | — | — |
| 6 | NONE | — | GMS | 1.2 | — | .24 | .27 | — | — |
| 7 | NONE | — | GMS | 1.6 | — | .31 | .44 | — | — |
| 8 | NONE | — | HENKEL DEHYDAT 8312 | 4.9 | — | .11 | .12 | — | — |
| 9 | NONE | — | HENKEL DEHYDAT 8312 | 4.9 | 1" | .08 | .09 | — | — |
| 10 | GMS* | .1 | NO COATING APPLIED | — | — | >120 | >120 | — | — |
| 11 | GMS | .1 | NONE | — | — | >120 | >120 | — | — |
| 12 | GMS | .1 | GMS | .8 | — | .19 | .24 | 3.52 × 10(11) | 9.43 × 10(13) |
| 13 | GMS | .1 | GMS | 1.0 | — | .27 | .29 | 1.16 × 10(11) | 1.75 × 10(13) |
| 14 | GMS | .1 | GMS | 1.6 | — | .19 | .21 | — | — |
| 15 | GMS | .1 | HENKEL DEHYDAT 8312 | 4.9 | — | .06 | .08 | 4.11 × 10(11) | 3.99 × 10(13) |
| 16 | GMS | .1 | GMS | 1.0 | 1" | .14 | .06 | 1.30 × 10(11) | 4.07 × 10(13) |
| 17 | GMS | .1 | HENKEL DEHYDAT 8312 | 4.9 | 1" | .01 | .02 | 5.90 × 10(10) | 9.46 × 10(13) |
| 18 | GMS | .3 | NO COATING APPLIED | — | — | >120 | >120 | — | — |
| 19 | GMS | .3 | NONE | — | — | >120 | >120 | — | — |
| 20 | GMS | .3 | GMS | .8 | — | .11 | .11 | — | — |
| 21 | GMS | .3 | GMS | 1.2 | — | .33 | .33 | — | — |
| 22 | GMS | .3 | GMS | 1.6 | — | .22 | .25 | — | — |

NOTES: FOR NFPA 99 TEST, THE VALUE OF >120 SECONDS MEANS THAT THE FABRIC EXHIBITED NO ANTISTATIC OR STATIC DISSIPATIVE PROPERTIES
*GMS IS GLYCEROL MONOSTEARATE

All other samples containing the specified levels of antistat in the coating passed the NFPA-99 test measured on both the coated and uncoated sides of the fabric. The time for dissipation of 5,000 volts to 500 volts was less than 0.5 seconds in all cases. A comparison of Examples 8 and 15 and 7 and 14 illustrates further improvement in static decay time where the antistat is present in both the fabric and coating composition.

Further enhancement in static decay time is shown with respect to those fabrics containing conductive silver coated nylon filaments interwoven with the warp threads of the fabric. This is illustrated by comparing the static decay times for Examples 8 and 9 as well as Examples 13 and 16, and 15 and 17.

Samples tested for surface resistivity (Examples 12, 13 and 15–17) all showed a diminution of resistivity as compared with control Examples 3 and 4.

Whatis claimed is:

1. A fabric material comprising:

(a) a fabric body formed of interwoven warp and weft yarns of axially oriented, crystalline polypropylene composition, said polypropylene composition containing from 0 to about 2% by weight, based on the weight of polypropylene, of a polyol ester of a $C_{10}$ to $C_{28}$ monocarboxylic acid antistatic agent, and (b) a coating of a thermoplastic polymer composition adhered to at least one side of said fabric body, said thermoplastic polymer composition containing from about 0.2 to about 8% by weight, based on the weight of thermoplastic polymer, of a polyol ester of a $C_{10}$ to $C_{28}$ monocarboxylic acid antistatic agent.

2. The fabric of claim 1 wherein said antistatic agent is a monoglycerol ester of a $C_{10}$ to $C_{22}$ monocarboxylic acid.

3. The fabric of claim 1 wherein said anti static agent is glycerol monostearate.

4. The fabric of claim 1 wherein said crystalline polypropylene composition contains at least about 0.05% by weight of said antistatic agent.

5. The fabric of claim 4 wherein said thermoplastic polymer coating contains from about 0.4 to about 7% by weight of said antistatic agent.

6. The fabric of claim 1 wherein said thermoplastic polymer coating composition contains a polymer selected from the group consisting of polyethylene, polypropylene, polyisobutylene, copolymers of ethylene with an alpha olefin selected from propylene and butene, and mixtures thereof.

7. The fabric of claim 1 wherein an electrically conductive filament is in contact with said warp or weft threads at spaced intervals.

8. The fabric of claim 7 wherein said metal filament is interwoven with said warp threads at a spaced interval of one fiber per about ½ to 2 inches of warp fabric width.

9. The fabric of claim 6 wherein said thermoplastic coating comprises polypropylene.

10. The fabric of claim wherein said coating has a thickness within the range of from about 0.5 to about 3.0 mils.

11. The fabric of claim 4 wherein said crystalline polypropylene composition contains up to about 1% by weight of said antistatic agent.

12. The fabric of claim 7 wherein said electrically conductive filament is a silver coated nylon filament.

* * * * *